US007735550B2

(12) United States Patent
Sun et al.

(10) Patent No.: US 7,735,550 B2
(45) Date of Patent: Jun. 15, 2010

(54) THROTTLE UNIT FOR DUMP BAILER AND METHOD OF BLOCKING A WATER OUT ZONE IN A PRODUCTION WELL UTILIZING THE SAME

(75) Inventors: Chi San Sun, Miaoli County (TW); Chien I Wu, Miaoli County (TW); Chia Shui Wu, Miaoli County (TW); Lai Fuh Fan, Miaoli County (TW); Te Kun Huang, Miaoli County (TW); Chen Hui Fan, Miaoli County (TW)

(73) Assignee: CPC Corporation, Taipei (TW)

( * ) Notice: Subject to any disclaimer, the term of this patent is extended or adjusted under 35 U.S.C. 154(b) by 98 days.

(21) Appl. No.: 11/833,736

(22) Filed: Aug. 3, 2007

(65) Prior Publication Data

US 2009/0032256 A1 Feb. 5, 2009

(51) Int. Cl.
*E21B 27/00* (2006.01)
*G05D 7/01* (2006.01)

(52) U.S. Cl. ..... 166/169; 138/43; 138/46

(58) Field of Classification Search ..... 166/334.3, 166/334.4, 330, 334.1, 169; 138/43, 46, 138/42
See application file for complete search history.

(56) References Cited

U.S. PATENT DOCUMENTS

| | | | | |
|---|---|---|---|---|
| 1,698,826 | A * | 1/1929 | Shaffer | 137/556.3 |
| 2,000,750 | A * | 5/1935 | Gates | 166/163 |
| 3,311,131 | A * | 3/1967 | Zahuranec | 138/44 |
| 6,595,281 | B1 * | 7/2003 | Beach | 166/169 |
| 7,108,071 | B2 * | 9/2006 | Freiheit et al. | 166/373 |

* cited by examiner

*Primary Examiner*—David J Bagnell
*Assistant Examiner*—Catherine Loikith
(74) *Attorney, Agent, or Firm*—Rabin & Berdo, PC

(57) ABSTRACT

A method of blocking a water out zone in a production well includes the steps of connecting a throttle unit to a dump bailer, wherein the throttle unit is internally defined a flowing space, which can be adjusted in size to thereby control a flow rate of cement for blocking the water out zone; loading the cement into the dump bailer; slowly lowering down the loaded dump bailer to the water out zone in the production well; opening an outlet of the dump bailer under control, so that the cement flows from the dump bailer into the throttle unit and is released at a flow rate preset by adjusting the size of the flowing space; allowing the released cement to load up in the water out zone and slowly permeate into a gravel layer in the production well before becoming cured to block the water out zone.

7 Claims, 9 Drawing Sheets

THROTTLE UNIT FOR DUMP BAILER AND METHOD OF BLOCKING A WATER OUT ZONE IN A PRODUCTION WELL UTILIZING THE SAME

FIELD OF THE INVENTION

The present invention relates to a throttle unit for dump bailer and a method of blocking a water out zone in a production well utilizing the throttle unit; and more particularly, to a throttle unit mounted to a bottom of a dump bailer for controlling a flow rate of cement or liquid resin used to block a water out zone in an oil/gas production well to achieve complete and reliable water blocking effect.

BACKGROUND OF THE INVENTION

Gas, oil, and water coexist in the stratum of an oil/gas production well. Since gas and oil have specific gravities lower than that of water, they are floating on the water. When the oil/gas production reaches a certain volume, formation water would gradually rise to approach perforated zones in the well and tends to enter the production well.

Generally, entering of water into a production well might be caused by different reasons, such as a high permeability formation at the production zone that results in an earlier edge encroachment on the well, vertical cracks or faults within the production zone that result in flowing of bottom formation water into the upper production zone, fissures on a casing or a plug set in the well, and poor cement bond at the casing of the well. Or, a rising water gas contact (WGC) would induce water coning to resulting in increased water rate and shutoff of well. Under these conditions, the water must be completely shut off lest it should rise and enter the well to adversely affect the production at other zones.

In the case of a gravel packed production well subjected to water encroachment, since the gravels between a screen pipe and a wall of the well is highly permeable and there is not a casing provided at the production zone, both of the mechanical type bridge plug and the thermal expansion type patch flex are not applicable to block the perforated zone under the WGC for the purpose of continuing the oil/gas production of the well.

The conventional bridge plug can only be mounted in the screen pipe, and does not provide the function of blocking tiny meshes on the screen pipe and the gravels outside the screen pipe. That is, the conventional bridge plug does not function to seize invasive water from flowing into the well. Similarly, the thermal expansion type patch flex must also be provided in the screen pipe. As to the conventional way of pumping gel into the gravel packed production well using coiled tubing, since the tiny meshes on the screen pipe and the gravels outside the screen pipe are highly permeable, the pumped gel would inevitably flow through the gravels and fails to completely enter a water out zone in the production well.

Regarding the way of placing traditional G-grade or H-grade cement milk at the well bottom to block the water out zone, it is also not applicable because the cement has large grain size and does not pass through the screen pipe into the gravels easily. Therefore, once the bottom of the gravel packed production well is subjected to invasion by water, there is no way to save the well but leaving it to the rising water until the well is no longer economical for use and shut off, or until the invaded water accumulates in the oil pipe and the well no longer produces any oil or gas.

For gravel packed production wells, a most common way of stopping water invasion is to use thermosetting resin or fine-grained cement milk to block the water out zone in the production well. In most cases, the resin used for this purpose is phenolic resin. However, in the case of stopping water invasion with the thermosetting resin, the formation water would still break through a joint of the gravels and the well wall to largely reduce the water blocking effect when a differential pressure at the well bottom exceeds 50 psi. There is also limitation to the cement used to block water. Only the fine-grained cement can flow into the gravels to completely fill up the pore space thereof, and thus blocks the water out zone after the cement is cured.

In performing water blocking for the gravel packed production well, a dump bailer is used to carry the resin or cement. The dump bailer is a cylindrical container being lowered to the well bottom or a desired depth in the well using a wire line. A signal is transmitted from the ground to open the dump bailer and release the resin or cement milk loaded therein. Due to a difference in specific gravity between the resin or cement milk and the formation water, the resin or cement milk is able to flow into the meshes and the gravels. When the resin or cement milk is cured, the water out zone is blocked.

However, in the conventional way of releasing the cement from the dump bailer, it is not able to control a flow rate of the released cement. Once a bottom opening of the dump bailer is opened, the cement in the dump bailer immediately flows out to mix with the formation water, resulting in an excessively low concentration of the cement and preventing the cement from curing effectively to thoroughly block the water out zone. That is, the quickly released cement does not provide good water blocking effect and the formation water tends to rise via the incompletely filled pore spaces of the gravels to adversely affect the oil/gas production at other production zones.

When the dump bailer is operated while the well has water therein, the releasing speed of the cement milk has great influence on the mixture of the cement milk with water, and accordingly the concentration of the cement milk. When the cement milk is released at a high speed, the cement milk mixed with the formation water is highly diluted to the extent of being unable to cure and losing the function of blocking water. This condition can be observed in lab experiments. On the other hand, when the cement milk is released at a controlled slow speed, the undesirable dilution of the cement milk can be largely improved.

SUMMARY OF THE INVENTION

A primary object of the present invention is to provide a throttle unit for a dump bailer used in blocking a water out zone in a production well, so that water-blocking cement is released from the dump bailer via the throttle unit at a controlled rate to facilitate complete curing and good water blocking effect of the cement at the water out zone of the production well.

Another object of the present invention is to provide a method of blocking a water out zone in a production well by allowing cement to release from a pump bailer via a throttle unit, so that the cement could be accurately controlled at a preset flow rate to slowly permeate into a gravel layer of the production well and effectively block the water out zone.

To achieve the above and other objects, the method of the present invention for blocking a water out zone in a production well includes the steps of connecting a throttle unit to a lower end of a dump bailer; using an adjustable flowing space in the throttle unit to set a flow rate for a water-blocking fluid; loading the water-blocking fluid in the dump bailer; hanging the loaded dump bailer from an overhead work platform, and lowering the dump bailer to the water out zone; opening an outlet of the dump bailer when the dump bailer has been lowered to the water out zone, so that the water-blocking fluid in the dump bailer is released via the throttle unit at the preset flow rate to load up in the water out zone; allowing the water-blocking fluid to slowly permeate into a surrounding gravel layer in the well due to a difference in density between the water-blocking fluid and the gravel layer; and allowing the water-blocking fluid to reach an outer edge of the gravel layer and cure to thereby reliably block the water out zone.

Wherein, the throttle unit is connected to a bottom nose of the dump bailer, and the water-blocking fluid may be cement or a liquid resin.

The throttle unit for dump bailer according to a preferred embodiment of the present invention includes a hollow outer barrel and a hollow inner barrel. The outer barrel has an upper end serving as a joining end, at where a joining structure is provided, and a lower end serving as a releasing end. An annular conical surface is formed inside the outer barrel between the joining end and the releasing end. The inner barrel is connected to and received in the joining end of the outer barrel, and has an upper end provided with a connecting section for connecting to the dump bailer and a lower end provided with an engaging section for engaging with the joining structure of the outer barrel. A contacting section is downward extended from the lower end of the inner barrel by a predetermined length. The contacting section is provided on an annular wall with a plurality of spaced through holes, and has a bottom shaped into a conical guiding surface corresponding to the annular conical surface in the outer barrel. Wherein the inner barrel is height adjustably received in the joining end of the outer barrel, so that a size-adjustable flowing space is defined between the conical guiding surface at the bottom of the contacting section and the annular conical surface in the outer barrel.

The connecting section at the upper end of the inner barrel may include a plurality of internal or external screw threads, or other types of connecting structure, depending on a bottom structure of the dump bailer.

In an embodiment of the present invention, the joining structure at the upper end of the outer barrel includes a plurality of internal screw threads, and the engaging section of the inner barrel includes a plurality of external screw threads adapted to mesh with the internal screw threads at the upper end of the outer barrel; such that the inner barrel may be screwed into the outer barrel by different depths to adjust the size of the flowing space.

In an operable embodiment of the present invention, the releasing end of the outer barrel has an inner bore smaller than that of the joining end.

In another preferred embodiment, the joining structure at the upper end of the outer barrel and the engaging section of the inner barrel are configured as a tenon joint. In this case, the joining structure includes at least one vertical row of retaining holes, and the engaging section includes at least one key that is elastically releasably received in any one of the retaining holes of the joining structure and can be pushed to retract into the inner barrel.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
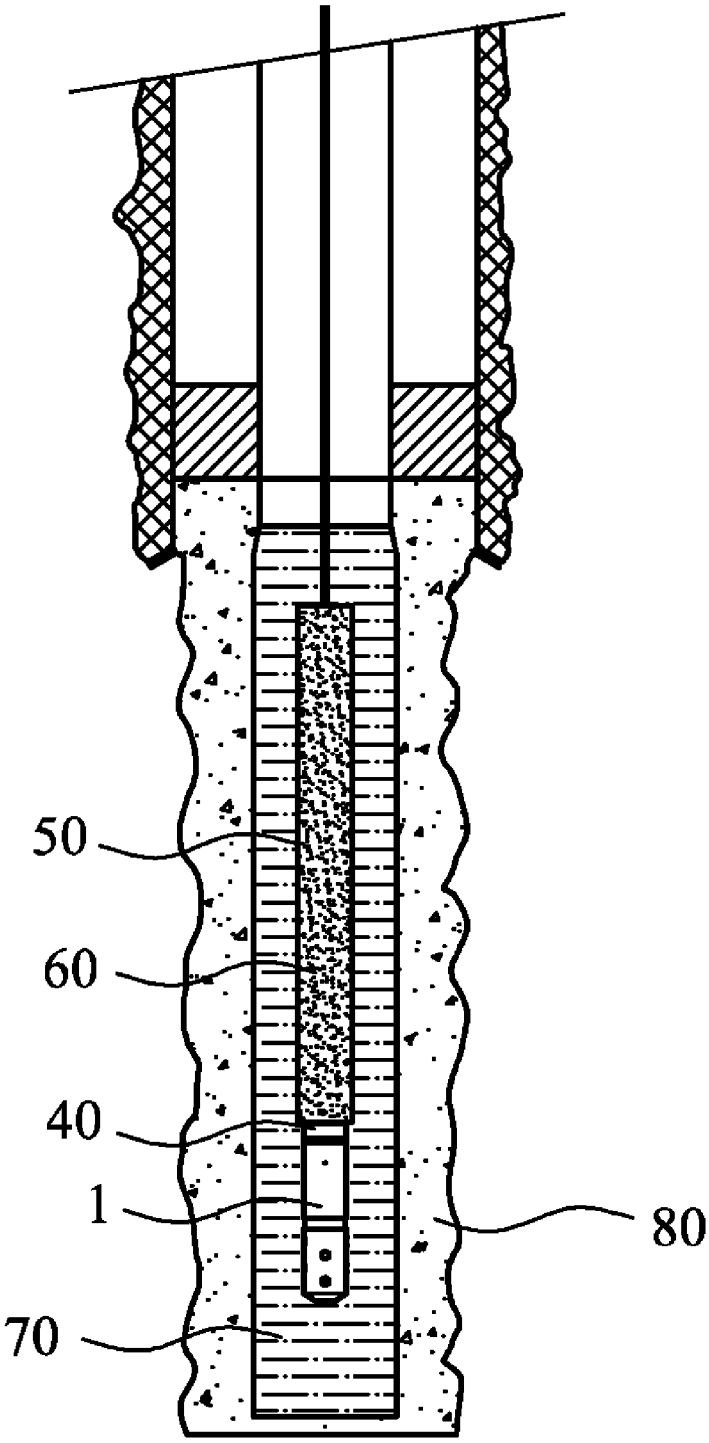
FIG. 1 shows a dump bailer with a throttle unit connected thereto and having cement loaded therein is lowered into an oil production well for blocking a water out zone according to a method of the present invention.
Figure 2:
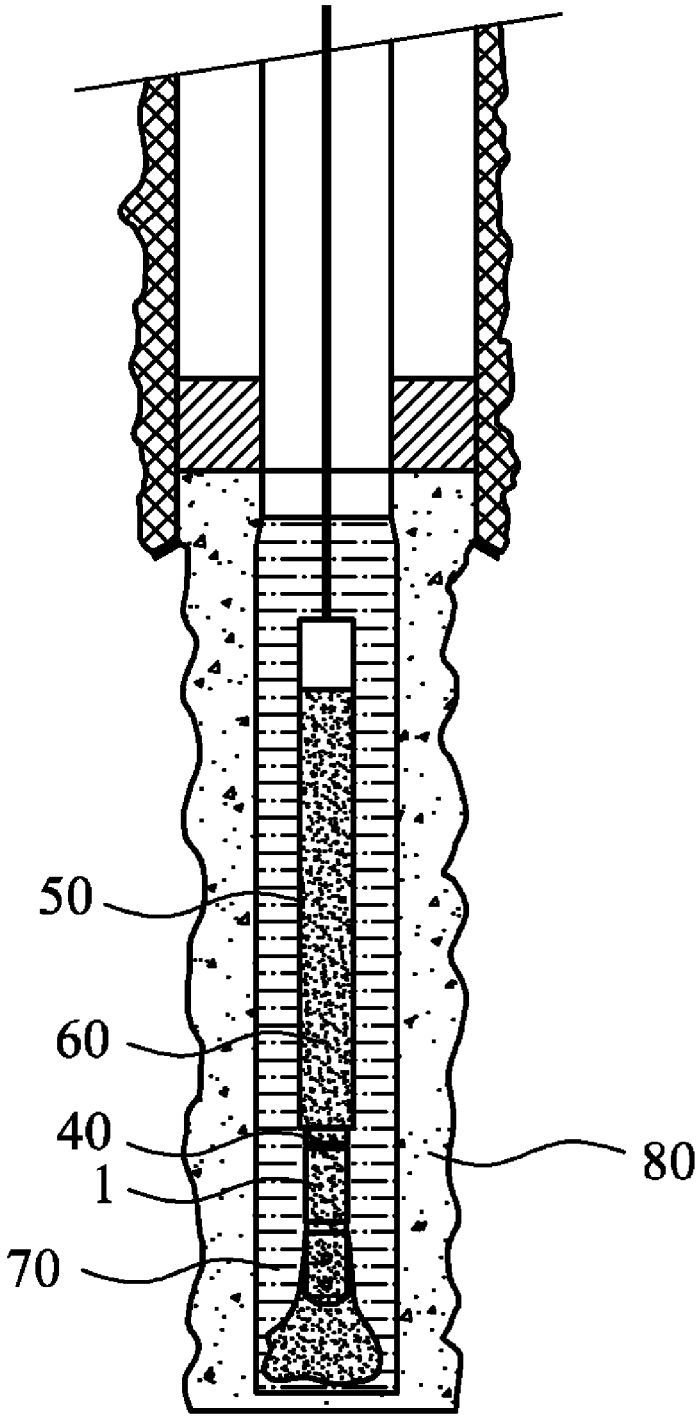
FIG. 2 shows the cement is let out of the dump bailer of FIG. 1 via the throttle unit.
Figure 3:
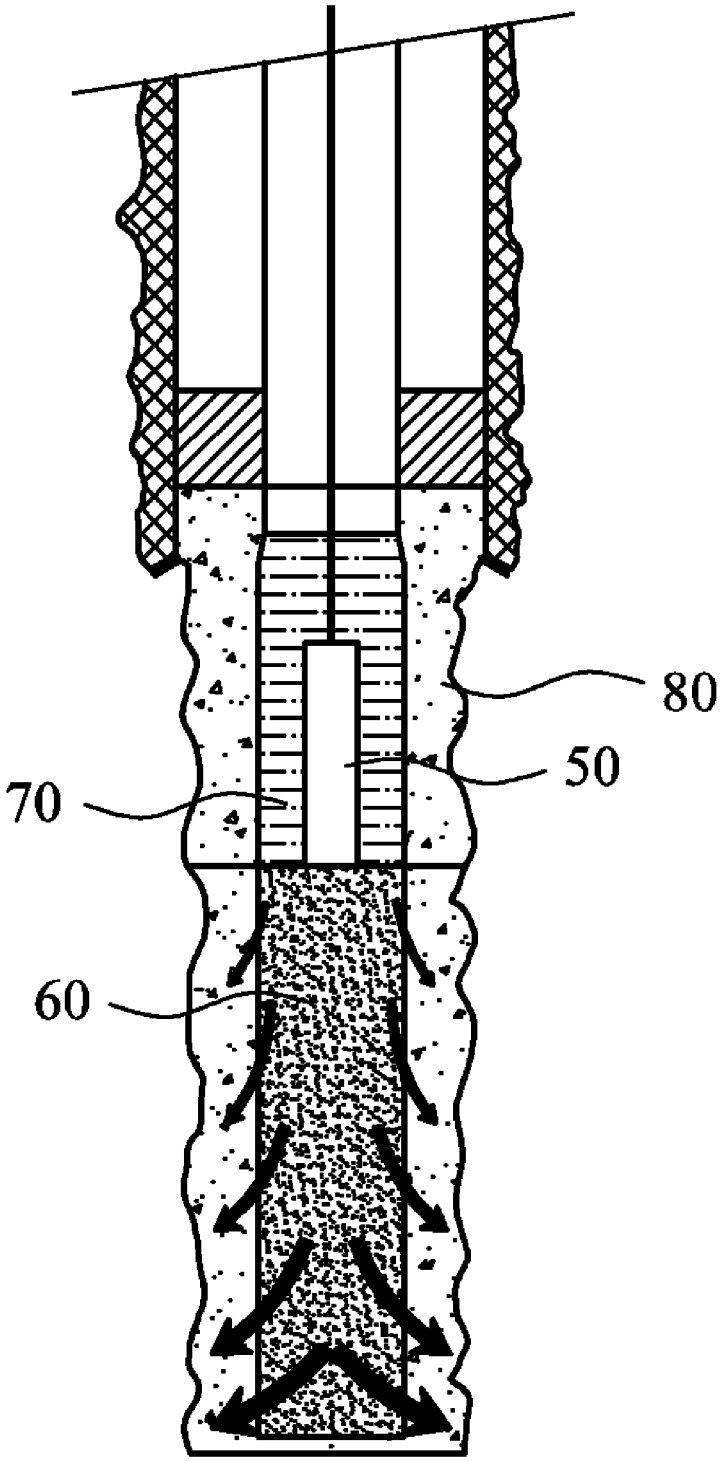
FIG. 3 shows the cement of FIG. 2 flows into a screen pipe at a preset flow rate, and further permeates into gravels outside the screen pipe.
Figure 4:
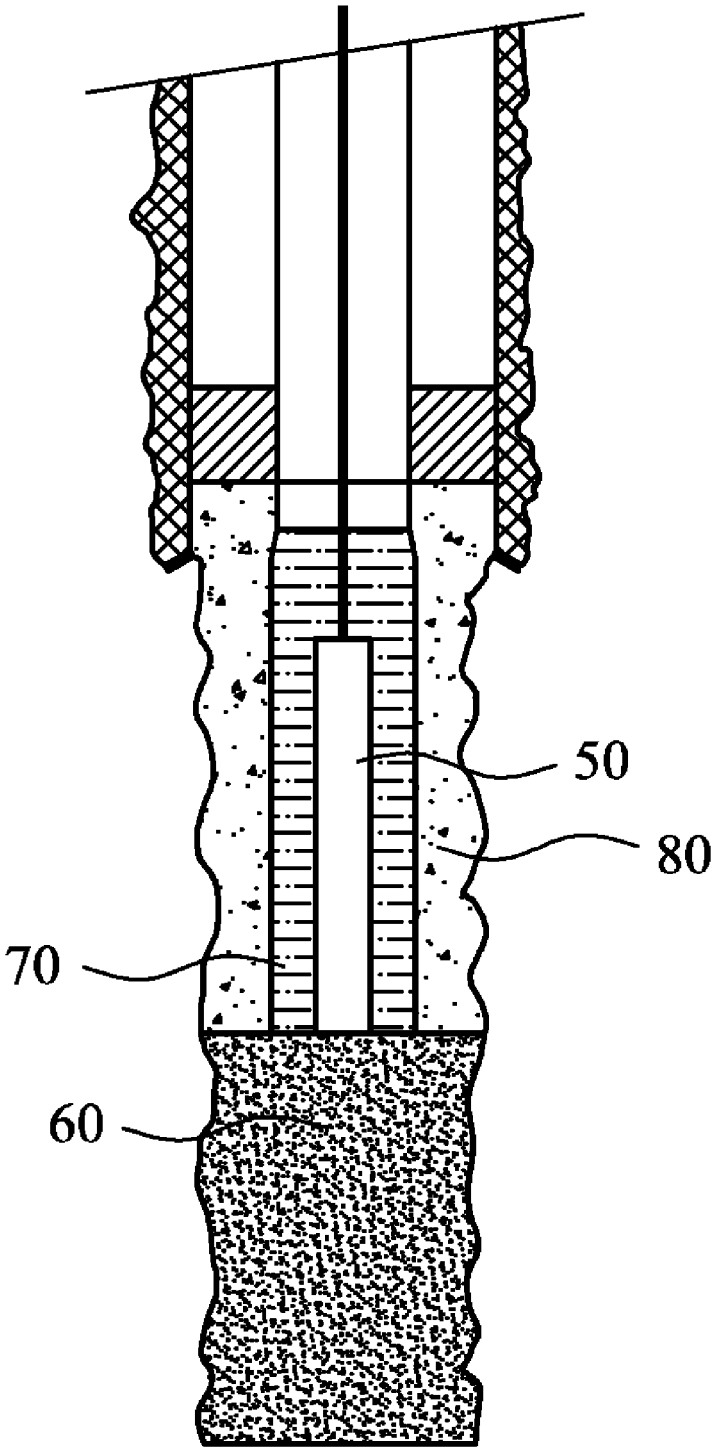
FIG. 4 shows the cement permeated into the gravels is cured to thereby block the water out zone.

Please refer to FIGS. 1 to 4. The present invention provides a method of blocking a water out zone in a production well utilizing a throttle unit connected to a lower end of a dump bailer. The method includes the steps of (1) measuring to obtain different data in the well, including the position, the temperature, and the pressure of the water out zone; (2) calculating to preset a flowrate for a predetermined water-blocking fluid; (3) preparing an amount of cement milk 60 and checking to ensure the prepared cement milk has a viscosity satisfying a required standard; (4) adjusting a throttle unit 1 based on the preset flow rate; (5) connecting the adjusted throttle unit 1 to a bottom nose 40 of a dump bailer 50; (6) loading the prepared cement milk 60 into the dump bailer 50, and hanging the loaded dump bailer 50 from an over head work platform; (7) slowly and carefully lowering down the loaded dump bailer 50 to the water out zone in the well to avoid any collision of the dump bailer 50 with anything in the well; (8) opening an outlet of the dump bailer 50 under control when the dump bailer has been lowered to a desired position in the water out zone, so that the cement milk 60 flows from the dump bailer into the throttle unit 1; (9) allowing the cement milk 60 to release from the throttle unit 1 and load up in a screen tube 70 at the water out zone, as shown in FIG. 3, so that the cement milk 60 slowly permeates through the screen tube 70 into a gravel layer 80 surrounding the screen tube 70 due to a differential pressure produced by different densities between the cement milk 60 and the gravel layer 80; and (10) allowing the cement milk 60 to reach an outer edge of the gravel layer 80 and gradually cure to completely and reliably block the whole water out zone.

It is noted the lowered dump bailer 50 should be hoisted to discard the loaded cement milk 60 when the dump bailer 50 has been lowered down to the water out zone for a time period exceeded 60 minutes. This is because, according to lab experiment evaluation, the prepared cement milk 60 can only maintain a satisfied fluidity within 60 minutes after the preparation. That is, the fluidity of the prepared cement milk 60 deteriorates after 60 minutes and would adversely affect the water blocking effect at the water out zone.

In an operable embodiment, a liquid resin is used as a water-blocking fluid to replace the cement milk 60.

Following experiments have been conducted based on the method according to the preferred embodiment of the present invention to observe the influence of the cement milk releasing rate on the dilution extent of the cement milk:

A 9.5"Φ acrylic pipe is adopted in the experiments to simulate a well bore, a real screen pipe having an outer diameter of 5.5" and an inner diameter of 4.4" is positioned in the acrylic pipe, a lab-prepared formation water having a saltness of 23000 ppm is filled into the acrylic pipe, and an amount of 20/40 mesh gravels is filled into the acrylic pipe outside the screen pipe. Before the cement milk 60 is positioned into the acrylic pipe, the whole system has a temperature of 70° C., and the cement milk is cured by preheating to 90° C. in advance.

Example 1

Use a dump bailer having an outer diameter of 1.52" and an inner diameter of 1.456". Keep the dump bailer still for 12 seconds. Three metric liters of cement is released at a flow rate of 1 liter/4 seconds. A volume expansion rate of 18% is observed.

Example 2

Use a dump bailer having an outer diameter of 1.52" and an inner diameter of 1.456". Keep the dump bailer still for 20 seconds. Three metric liters of cement is released at a flow rate of 1 liter/6.67 seconds. A volume expansion rate of 14% is observed.

From the above examples, it is observed when the cement milk is slowly release data lower flow rate, the dilution extent of the cement milk is largely improved and the volume expansion rate of the cement is reduced, enabling the cement to have increased density and pressure resistance to ensure effective water blocking.

Figure 5:
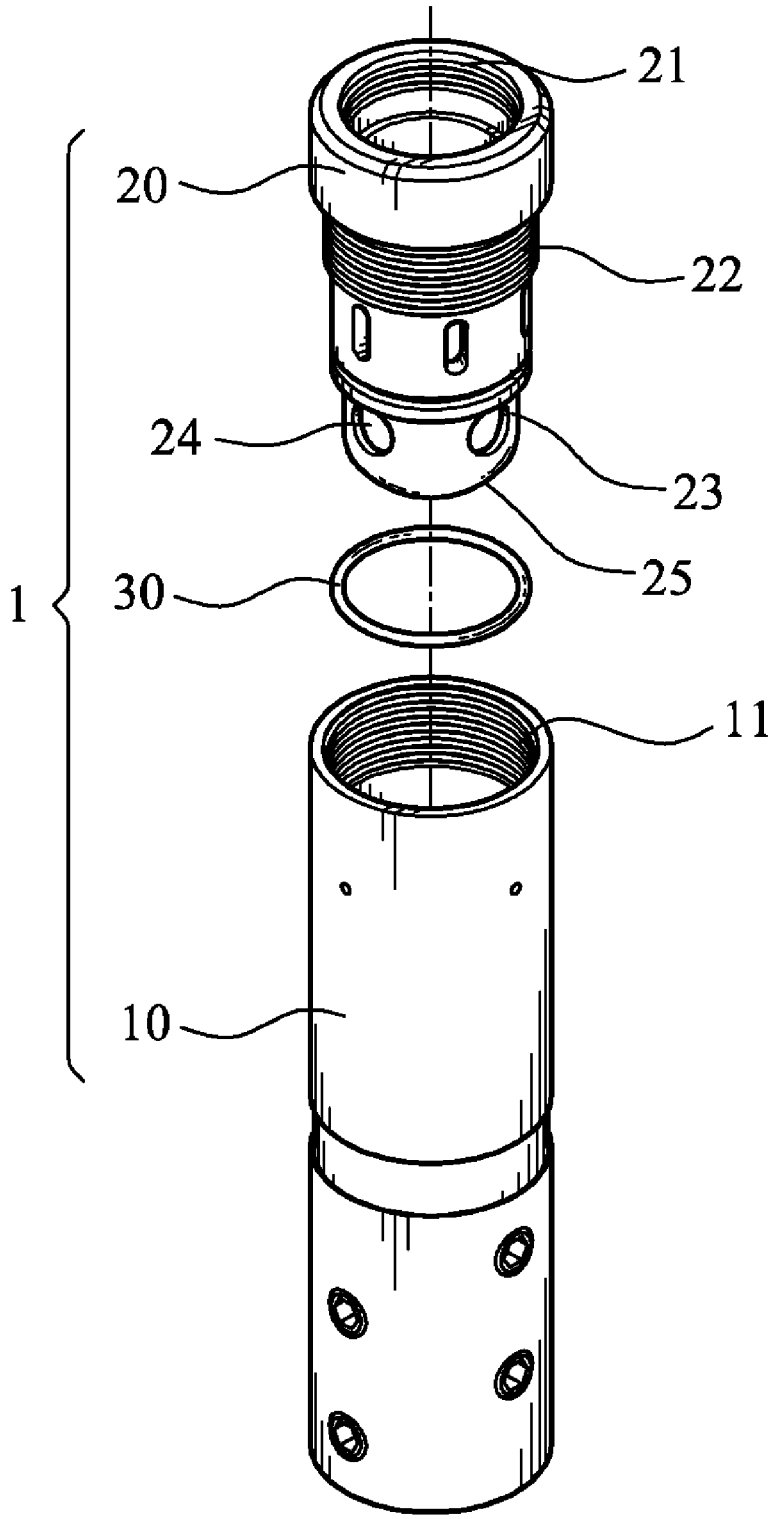
FIG. 5 is an exploded perspective view of a throttle unit for dump bailer according to a preferred embodiment of the present invention.

The present invention also provides a throttle unit 1 for connecting to a dump bailer 50 used in blocking a water out zone in a production well, so as to control a flow rate at which a predetermined water-blocking fluid in the dump bailer 50 is released via the throttle unit 1. Please refer to FIG. 5 that is an exploded perspective view of the throttle unit 1, and to FIGS. 6 and 7 that are assembled vertical sectional views showing the throttle unit 1 set to a position for high flow rate and a position for low flow rate, respectively. As shown, the throttle unit 1 includes a hollow outer barrel 10 and a hollow inner barrel 20. The outer barrel 10 has an upper end internally provided with a joining structure 11 to serve as a joining end, a lower end serving as a releasing end, and an annular conical surface 12 formed in the outer barrel 10 at a joint of the joining end and the releasing end, as can be seen from FIGS. 6 and 7. The inner barrel 20 is connected to and received in the joining end of the outer barrel 10, and has an upper end internally provided with a connecting section 21 and a lower end externally provided with an engaging section 22 corresponding to the joining structure 11 of the outer barrel 10. A contacting section 23 is downward extended from the lower end of the inner barrel 20 by a predetermined length. The contacting section 23 has an annular wall, along which a plurality of thorough holes 24 are spaced, and a bottom shaped into a conical guiding surface 25 corresponding to the annular conical surface 12 in the outer barrel 10.

In the illustrated preferred embodiment, the releasing end of the outer barrel 10 has an inner bore slightly smaller than that of the joining end.

In the illustrated preferred embodiment, the joining structure 11 at the upper end of the outer barrel 10 includes a plurality of internal screw threads, and the engaging section 22 on the inner barrel 20 includes a plurality of external screw threads adapted to mesh with the internal screw threads in the outer barrel 10, such that the inner barrel 20 may be screwed to and received in the outer barrel 10. To ensure an air and water tight connection of the inner barrel 20 to the outer barrel 10, a gasket ring 30 is internally set around the joining end of the outer barrel 10 to locate between an outer peripheral surface of the inner barrel 20 and an inner wall surface of the outer barrel 10 and slightly above the through holes 24.

Figure 6:
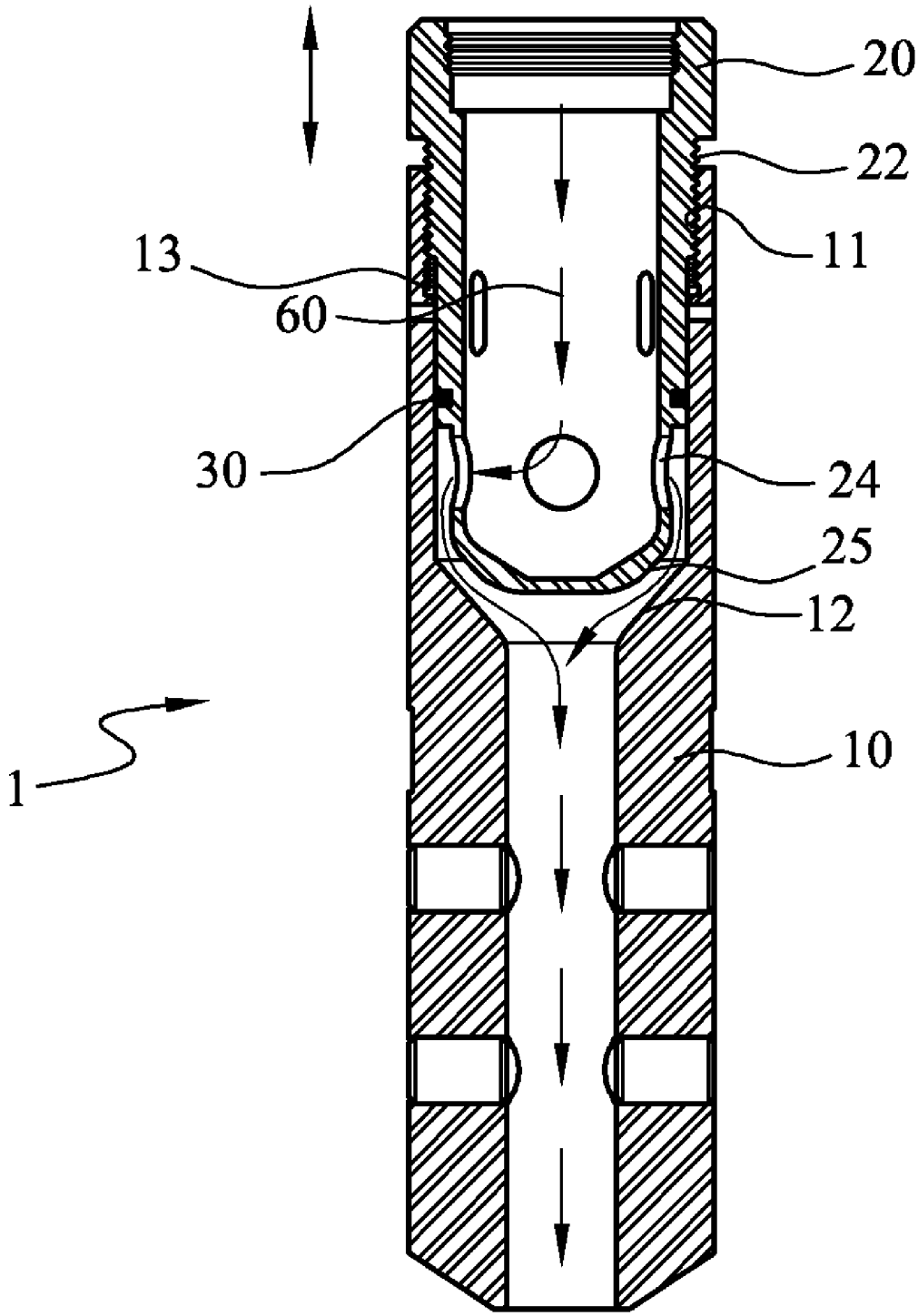
FIG. 6 is an assembled vertical sectional view of the throttle unit of FIG. 5 set to a position for high flow rate.
Figure 7:
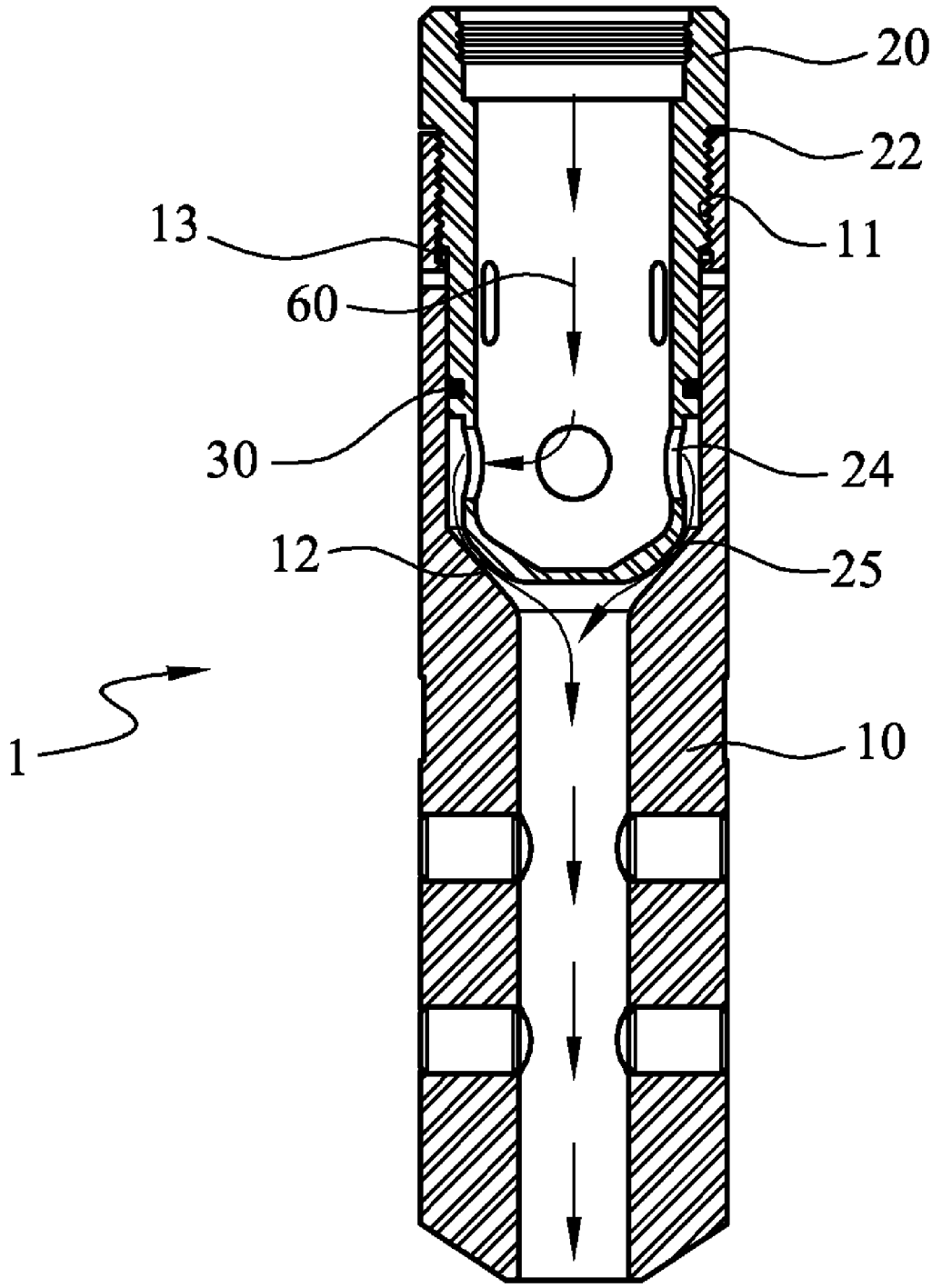
FIG. 7 is an assembled vertical sectional view of the throttle unit of FIG. 5 set to a position for low flow rate.

The inner barrel 20 may be screwed into the outer barrel 10 by different depths, as indicated by the double-head arrow in FIG. 6, to thereby adjust a distance between the conical guiding surface 25 at the bottom of the inner barrel 20 and the annular conical surface 12 in the outer barrel 10. The distance between the conical guiding surface 25 and the annular conical surface 12 provides a flowing space between the outer barrel 10 and the inner barrel 20, and is adjustable to change the size of the flowing space and thereby control the flow rate of the water-blocking fluid flowing therethrough. Therefore, a user may regulate the water-blocking fluid flow rate by adjusting the flowing space to a desired size. FIG. 7 shows the flowing space has been set to minimize the flow rate.

As can also be seen from FIGS. 6 and 7, a radially protruded stopper 13 is provided in the outer barrel 10 at a lower end of the joining structure 11, preventing the inner barrel 20 from being fully screwed to a lowest point to completely close the flowing space. Therefore, there is at least a minimum flowing space in the throttle unit 1 to enable a minimum flow rate.

In the preferred embodiment of the present invention, the fluid used for water blocking is cement 60, which contains a plurality of grains. To enable the cement 60 to smoothly flow through the flowing space without blocking up the throttle unit 1, a wall area on the contacting section 23 provided with the through holes 24 is slightly radially inward bent.

Please refer to FIGS. 6 and 7 again. The throttle unit 1 of the present invention functions as an adjustable valve. The engaging section 22 of the inner barrel 20 may be turned relative to the joining structure 11 of the outer barrel 10 in a predetermined direction to separate the conical guiding surface 25 of the contacting section 23 from the annular conical surface 12 to provide the flowing space, allowing the cement 60 to flow through the through holes 24 spaced on the contacting section 23 into the flowing space and the releasing end of the outer barrel 10 and be released into an environment outside the throttle unit 1. The flowing space between the inner barrel 20 and the outer barrel 10 may be adjusted based on the flow rate preset for the cement 60, so that the cement 60 is able to flow to the water out zone at the preset flow rate to thoroughly permeate into the gravel layer 80 and cure at an optimal curing rate, achieving the purpose of effectively blocking the water out zone.

The connecting section 21 at the upper end of the inner barrel 20 may include a plurality of internal or external screw threads, or may be configured corresponding to a member to be connected thereto.

As having been mentioned above, the throttle unit 1 of the present invention provides an adjustable flowing space between the annular conical surface 12 and the conical guiding surface 25 of the contacting section 23 by screwing the inner barrel 20 into the outer barrel 10 by different depths, so that the water-blocking fluid is allowed to smoothly flow through the flowing space into the releasing end of the outer barrel 10 and be released. In the illustrated preferred embodiment, the flowing space is adjustable through the screw threads provided at the joining end of the outer barrel 10 and the engaging section 22 of the inner barrel 20. However, it is understood the flowing space is also adjustable through other types of adjusting mechanism, such as a tenon joint. For instance, the joining structure 11 may include at least one vertical row of through retaining holes, and the engaging section 22 may correspondingly include at least one key adapted to elastically and releasably engage with any one of the vertically arranged retaining holes of the joining structure 11. The at least one key may be pushed to retract into the inner barrel 20 and disengage from the retaining hole, and can automatically spring outward when being released. When it is desired to adjust the flowing space, simply push the key for the same to retract into the inner barrel 20, and adjust the outer barrel 10 upward or downward to a desired position, and then allow the key to spring out and engage with the retaining hole at the desired position. In brief, the joining structure 11 and the engaging section 22 may include differently designed mechanical members to achieve the same purpose of adjusting the size of the flowing space.

Figure 8:
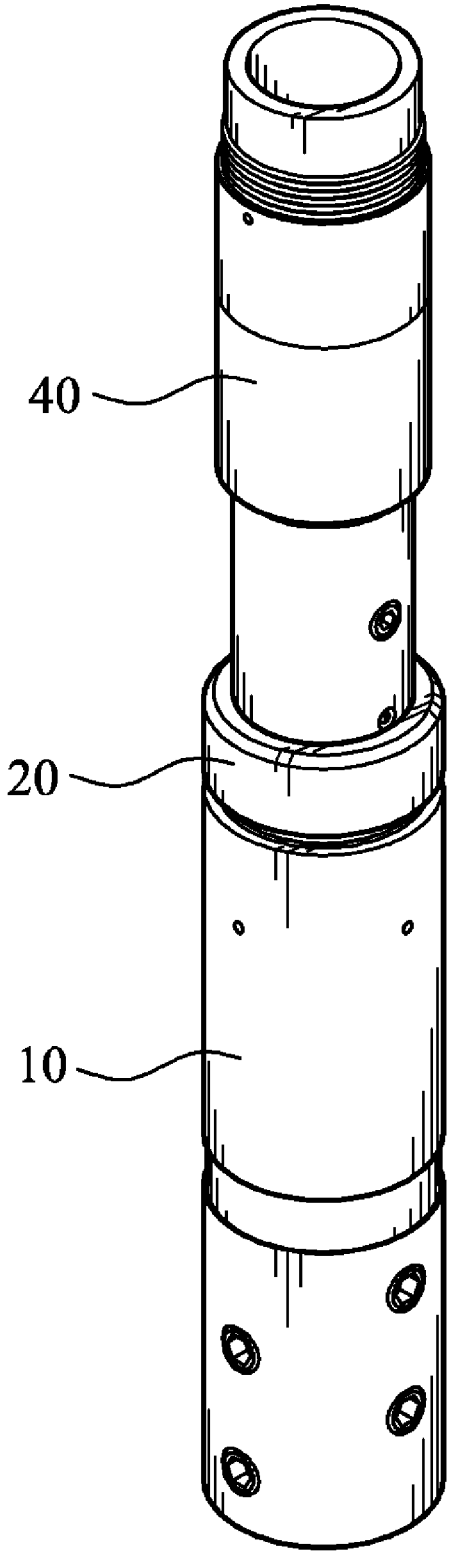
FIG. 8 is an assembled perspective view showing the throttle unit of the present invention is connected to a bottom nose of a dump bailer.
Figure 9:
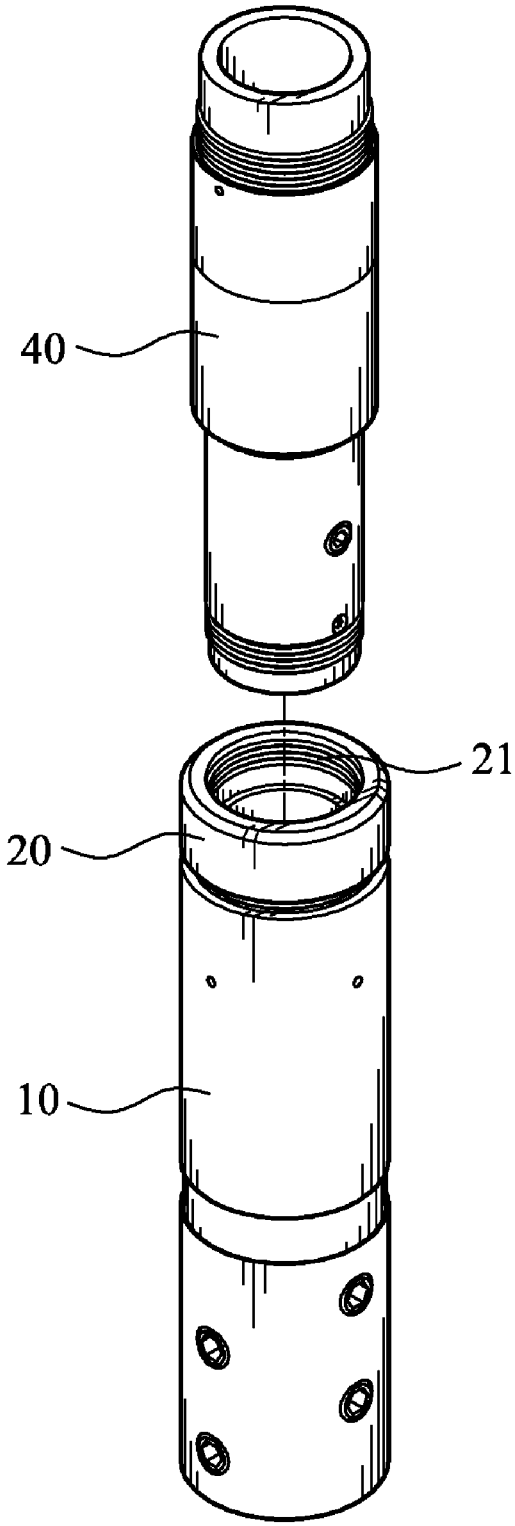
FIG. 9 is an exploded view of FIG. 8.

Please refer to FIGS. 8 and 9. The throttle unit 1 is connected to the dump bailer 50 by screwing the connecting section 21 at the upper end of the inner barrel 20 to the nose 40 at the bottom of the dump bailer 50, so that the throttle unit 1 serves as an adjustable valve of the dump bailer 50.

The throttle unit 1 of the present invention functions as an adjustable valve to provide the flowing space, which is adjustable by changing an engaged distance between the outer and the inner barrel 10, 20 to thereby enable regulation of the flow rate at which the water blocking fluid is released from the throttle unit 1 into the gravel layer 80 to best achieve the purpose of blocking the water out zone in the production well.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A throttle unit for a dump bailer used in blocking a water out zone in a production well, comprising:

a hollow outer barrel having an upper end and a lower end, the upper end serving as a joining end including a joining structure, and the lower end serving as a releasing end and including an annular conical surface formed inside the outer barrel between the joining end and the releasing end; and a hollow inner barrel connected to and received in the joining end of the outer barrel, the inner barrel having an upper end and a contacting section, the upper end including a connecting section connectable to the dump bailer and a lower end including an engaging section engageable with the joining structure of the outer barrel, and the contacting section being provided on an annular wall with a plurality of spaced through holes and extending downward from the lower end of the inner barrel by a predetermined length, and having a bottom shaped into a conical guiding surface corresponding to the annular conical surface in the outer barrel, wherein the inner barrel is height adjustably received in the joining end of the outer barrel, so that a size-adjustable flowing space is defined between the conical guiding surface at the bottom of the contacting section and the annular conical surface in the outer barrel by adjusting an amount of overlap between the joining structure of the outer barrel and the connecting section of the inner barrel to create the flowing space between the annular conical surface and the conical guiding surface, to release a fluid through the flowing space and the releasing end of the outer barrel.

2. The throttle unit for a dump bailer as claimed in claim 1, wherein the releasing end of the outer barrel has an inner bore smaller than that of the joining end.

3. The throttle unit for a dump bailer as claimed in claim 1, wherein the inner barrel is height adjustably received by being variably screwed into the outer barrel to adjust a distance between the conical guiding surface at the bottom of the contacting section and the annular conical surface in the outer barrel.

4. The throttle unit for a dump bailer as claimed in claim 3, wherein a radially protruded stopper is provided in the outer barrel at a lower end of the joining structure.

5. The throttle unit for a dump bailer as claimed in claim 1, wherein a wall area on the contacting section provided with the through holes is slightly bent inward in a radial direction.

6. The throttle unit for a dump bailer as claimed in claim 1, wherein the joining structure includes at least one vertical row of through retaining holes, and the engaging section correspondingly includes at least one key adapted to elastically and releasably engage with any one of the vertically arranged retaining holes of the joining structure; the at least one key pushed to retract in the inner barrel and disengage from the retaining hole, and can automatically spring outward when being released.

7. A throttle unit for a dump bailer used in blocking a water out zone in a production well, comprising:

a hollow outer barrel having an upper end and a lower end, the upper end serving as a joining end including a joining structure, and the lower end serving as a releasing end and including an annular conical surface formed inside the outer barrel between the joining end and the releasing end; and a hollow inner barrel connected to and received in the joining end of the outer barrel, the inner barrel having an upper end and a contacting section, the upper end including a connecting section connectable to the dump bailer and a lower end including an engaging section engageable with the joining structure of the outer barrel, and the contacting section being provided on an annular wall with a plurality of spaced through holes and extending downward from the lower end of the inner barrel by a predetermined length, and having a bottom shaped into a conical guiding surface corresponding to the annular conical surface in the outer barrel, wherein the inner barrel is height adjustably received in the joining end of the outer barrel, so that a size-adjustable flowing space is defined between the conical guiding surface at the bottom of the contacting section and the annular conical surface in the outer barrel, and the inner barrel is height adjustably received by being variably screwed into the outer barrel to adjust a distance between the conical guiding surface at the bottom of the contacting section and the annular conical surface in the outer barrel.

* * * * *